US007666025B2

(12) United States Patent
Cheng et al.

(10) Patent No.: US 7,666,025 B2
(45) Date of Patent: Feb. 23, 2010

(54) POWER CONNECTOR ASSEMBLY

(75) Inventors: I-Hung Cheng, Jhonghe (TW); Hung-Chi Tai, Jhonghe (TW)

(73) Assignee: Alltop Electronics (Su Zhou) Co., Ltd, Taicang, Jiangsu Province (CN)

( * ) Notice: Subject to any disclaimer, the term of this patent is extended or adjusted under 35 U.S.C. 154(b) by 3 days.

(21) Appl. No.: 12/058,965

(22) Filed: Mar. 31, 2008

(65) Prior Publication Data

US 2009/0197466 A1 Aug. 6, 2009

(30) Foreign Application Priority Data

Feb. 4, 2008 (CN) ..... 2008 1 0020593

(51) Int. Cl.
*H01R 13/00* (2006.01)

(52) U.S. Cl. ..... 439/485; 439/374; 439/680

(58) Field of Classification Search ..... 439/374, 439/485, 680

See application file for complete search history.

(56) References Cited

U.S. PATENT DOCUMENTS 6,086,419 A * 7/2000 Marpoe, Jr. ..... 439/595
6,319,075 B1 * 11/2001 Clark et al. ..... 439/825
6,666,698 B2 * 12/2003 Beck et al. ..... 439/181
7,452,249 B2 * 11/2008 Daily et al. ..... 439/825
7,458,839 B2 * 12/2008 Ngo et al. ..... 439/291

FOREIGN PATENT DOCUMENTS

EP 0951102 10/2004

* cited by examiner

*Primary Examiner*—Truc T Nguyen
(74) *Attorney, Agent, or Firm*—Sughrue Mion, PLLC

(57) ABSTRACT

A power connector assembly is provided which comprises a plug connector and a mating receptacle connector. The plug connector includes an insulative plug housing having a plurality of passageways divided by division walls and a plurality of plug terminals accommodated in the corresponding passageways of the plug housing. The receptacle connector includes an insulative receptacle housing having a receiving space for receiving a part of the plug housing inserted therein and a plurality of receptacle terminals accommodated in the receptacle housing for mating with the plug terminals. Airflow channels are formed between the outer surface of the part of the plug housing in the receiving space and the inner surface of the receiving space for dissipation of heat.

15 Claims, 9 Drawing Sheets

POWER CONNECTOR ASSEMBLY

CROSS REFERENCE TO RELATED APPLICATION

This application claims the benefit of Chinese Patent Application No. 200810020593.2, filed on Feb. 4, 2008 in Chinese Intellectual Property Office, the disclosure of which is incorporated herein by reference.

BACKGROUND OF THE INVENTION

1. Field of the Invention

The present invention relates to a power connector assembly, and more particularly to an assembly of a receptacle connector and a plug connector interconnecting two separate circuit boards for transmission of power therebetween.

2. The Prior Arts

When designing an electronic circuit, the designer generally will concern two basic parts, i.e., the part of logic (or signal) and the part of power. Because of the current flows through a logic circuit are usually low, the circuit designer needs not to consider the effect of status (for example, temperature) on electrical characteristics (for example, circuit component impedance) when designing a logic circuit. However, the current flows in a power circuit are relatively high which may cause significant change of the electrical characteristics. Therefore, when designing an electronic power connector, the dissipation of heat (due to joule effect) must be taken into account to minimize change of electrical characteristics subject to change of electric current.

Taiwan patent publication No. M319540 discloses a power connector assembly which comprises a receptacle connector adapted to be mounted on one circuit board and a plug connector adapted to be mounted on the other circuit board and mating with the receptacle connector. The receptacle connector comprises an insulative receptacle housing and a plurality of receptacle terminals arrayed in the receptacle housing, and the plug connector comprises an insulative plug housing and a plurality of plug terminals arrayed in the plug housing. Each receptacle terminal and each plug terminal have a main base plate bent and jointed at the top thereof and a pair of mounting arms extending forwardly from one side of the plate. The mounting arms of the plug terminal have a flat-plate shape while the mounting arms of the receptacle terminal have a bending shape. When the plug connector mates with the receptacle connector, the mounting arms of the plug terminal and the mounting arms of the receptacle terminals elastically contact with each other so as to establish an electrical connection. When the power connector assembly is used to transmit high current power, the relatively big area of the main plate of each terminal and the space between two adjacent main plates of each terminal are both favorable to the dissipation of heat generated during transmission of power. Additionally, a plurality of heat-dissipating holes is formed respectively in the top wall of the receptacle housing and the plug housing, which also is favorable to the dissipation of heat.

Although the above-mentioned structure of the power connector assembly is favorable to the dissipation of heat, it still has some shortcomings. Firstly, the heat-dissipate holes are only formed on the top wall of the insulative housing, which will limit the dissipating direction of heat only on one upward direction. Secondly, firmness and solidity of the insulative housing will decrease if too many heat-dissipating holes are formed in the top wall of the housing.

Furthermore, both the receptacle terminal and the plug terminal of the above-mentioned prior art comprises a one piece U-shape main plate made of metallic material. The bending portion of the U-shape plate has a risk of chapping during its manufacturing process, which will influence electrical characteristics of the terminal during power transmission. Moreover, when soldering the terminal to the circuit board, the high temperature of the soldering process will release stress of the bending portion, which will lead to mismatch of the solder legs of the terminal with the solder hole in the circuit board, and will cause failure of the soldering process.

Therefore, it is necessary to develop a new power connector assembly which has improved insulative housings and improved terminals.

SUMMARY OF THE INVENTION

Accordingly, an object of the present invention is to provide a power connector assembly having an improved heat-dissipating structure.

Another object of the present invention is to provide a power connector assembly having improved terminals with higher electrical characteristics and simplified manufacturing process.

To achieve the above-mentioned objects, a power connector assembly in accordance with a prefered embodiment of the present invention comprises a plug connector and a mating receptacle connector. The plug connector includes an insulative plug housing having a plurality of passageways divided by division walls and a plurality of plug terminals accommodated in the corresponding passageways of the plug housing. The receptacle connector includes an insulative receptacle housing having a receiving space for receiving a part of the plug housing inserted therein and a plurality of receptacle terminals accommodated in the receptacle housing for mating with the plug terminals. Airflow channels are formed between the outer surface of the part of the plug housing in the receiving space and the inner surface of the receiving space for dissipation of heat.

The plug housing comprises a main body having a plurality of ribs formed on the outer surface thereof, and the ribs resist onto the inner surface of the receiving space of the receptacle housing when a part of the main body is inserted into the receiving space. The ribs are formed at the corners of a front part of the main body where the top wall and the bottom walls of the main body joint with side walls of the main body, respectively. The heights of the ribs are respectively beyond the outer surface of the top wall, the bottom wall and the side walls of the main body. The rib also extends forwardly from the front surface of the main body and forms a position end resisting onto corresponding surface of the receiving space of the receptacle housing.

A pair of guiding posts is provided on two sides of the plug housing of the plug connector, and a pair of guiding recesses is provided on two sides of the receptacle housing of the receptacle connector for mating with the guiding post. Slots are formed in the inner side of guiding post, the slots communicates with the guiding recess and the guiding recess communicates with the receiving space of the receptacle housing to form airflow channel. A plurality of spaced ribs is provided on the inner surface of the top wall of the receiving space of the receptacle housing, the gap between adjacent ribs forming the airflow channel. A plurality of passageways is formed in the receptacle housing behind the receiving space for accommodating the receptacle terminals. The passageway has a pair of convection slots respectively provided at the upper wall and the lower wall of the passageway to form the airflow channel.

According to another aspect of the present invention, a power connector assembly comprises a receptacle connector and a mating plug connector. The receptacle connector includes a plurality of receptacle terminal couples and an insulative receptacle housing having a plurality of passageways each accommodating a receptacle terminal couple therein. Each receptacle terminal couple includes a pair of separate receptacle terminals spaced from each other in the passageway to form airflow channel therebetween. The plug connector includes a plurality of plug terminal couples and an insulative plug housing having a plurality of passageways each accommodating a plug terminal couple therein. Each plug terminal couple including a pair of separate plug terminals spaced from each other in the passageway to form a mating space for receiving a pair of contacting arm of the receptacle terminal couple.

Other objects, advantages and novel features of the present invention will become more apparent from the following detailed description of the preferred embodiment when taken in conjunction with the accompanying drawings.

DETAILED DESCRIPTION OF PREFERRED EMBODIMENT

Figure 1:
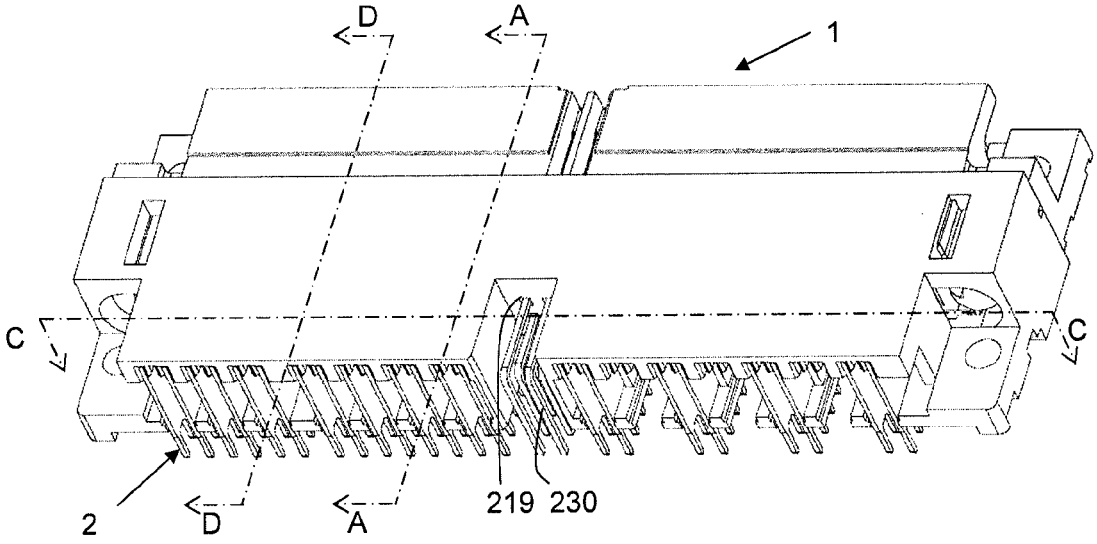
FIG. 1 is a perspective view of the power connector assembly in according with a preferred embodiment of the present invention, comprising a receptacle connector and a plug connector.
Figure 2:
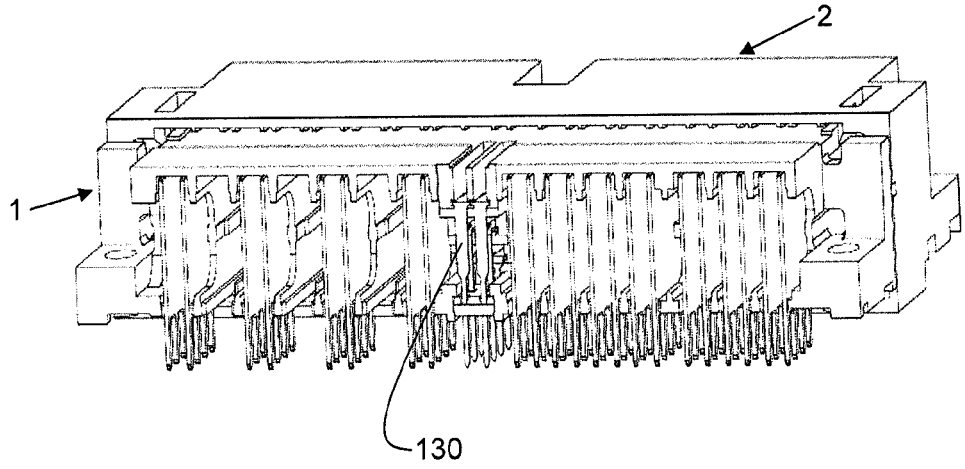
FIG. 2 is similar to FIG. 1, and taken from a different angle of view.

Referring to FIGS. 1 and 2, a power connector assembly in accordance with a preferred embodiment of the present invention comprises a first power connector having a first insulative housing with a plurality of first power terminals secured therein and a second power connector having a second insulative housing with a plurality of second power terminals secured therein, the first power connector mates with the second power connector so as to transmit high voltage and high current power via the first and the second power terminals provided therein. In the present embodiment, the first connector is a plug connector 1 having a plurality of plug terminals (also named as male terminals) secured therein and the second connector is a receptacle connector 2 having a plurality of receptacle terminals (also named as female terminals) secured therein. The plug connector 1 and the receptacle connector 2 are respectively mounted onto one circuit board, and power can be transferred between the two circuit boards when the plug connected mates with the receptacle connector.

Figure 3:
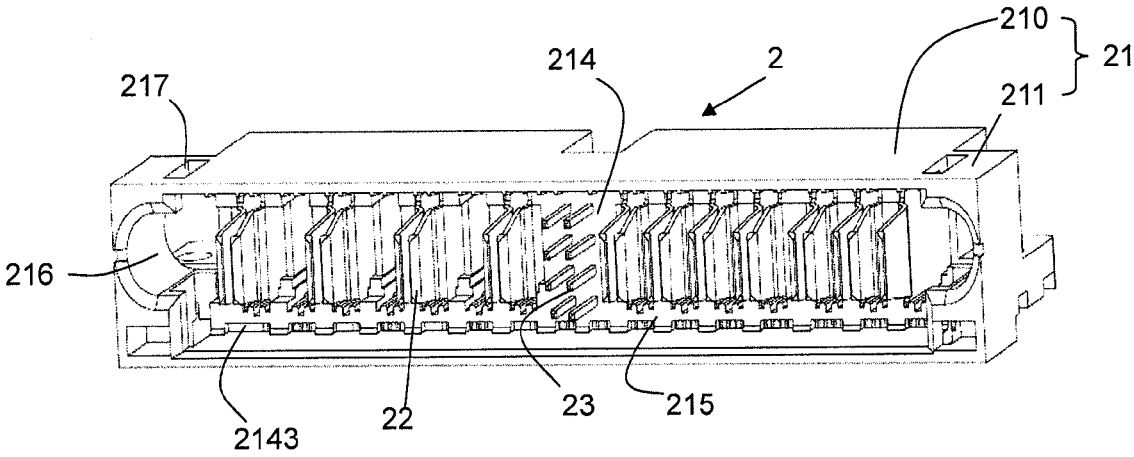
FIG. 3 is a perspective view of the receptacle connector of FIG. 1.
Figure 4:
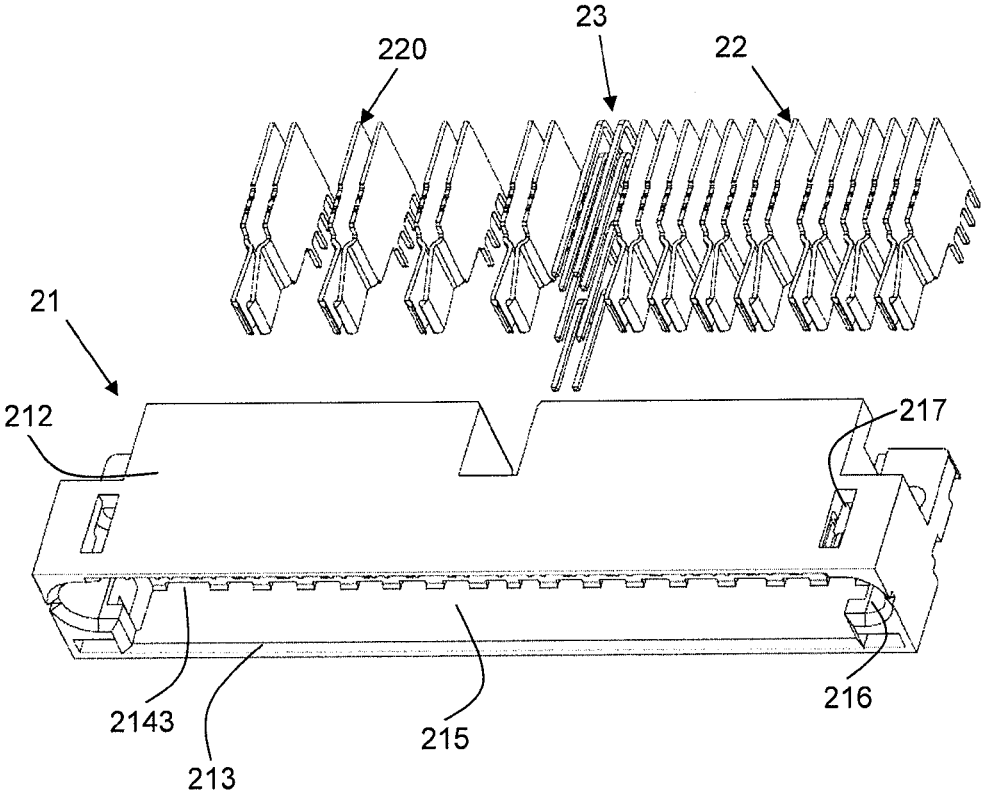
FIG. 4 is an exploded view of the receptacle connector of FIG. 3.
Figure 5:
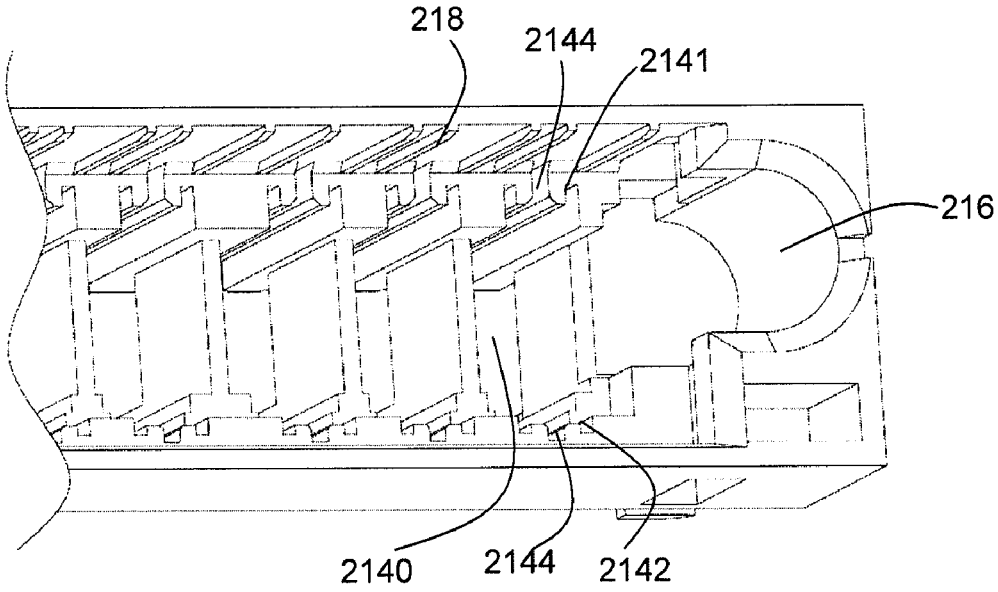
FIG. 5 is a partially enlarged view of an insulative receptacle housing of the receptacle connector of FIG. 3.

Referring to FIGS. 3 to 5, the receptacle connector 2 includes an insulative receptacle housing 21, a receptacle terminal group 22 and a first signal terminal group 23.

The insulative receptacle housing 21 is made of plastic material by means of injection mold process and has a rectangular shape along its longitudinal direction, which comprises a main body 210 for accommodating the receptacle terminals and side portions 211 respectively formed on either side of the main body 210. The main body 210 comprises a top wall 212, a bottom wall 213 parallel to the top wall 212, a middle wall 214 connecting the top wall 212 and the bottom wall 213, and a receiving space 215 formed along a front surface of the main body 210. Each side portion 211 comprises a guiding recess 216 communicating with the receiving space 215 and a through hole 217 formed on a top surface of the side portion 211 and communicating with the guiding recess 216. A plurality of ribs 218 is formed on a lower surface of the top wall 212 and extends rearwardly along the front surface of the main body 210 from the receiving space 215.

Figure 6:
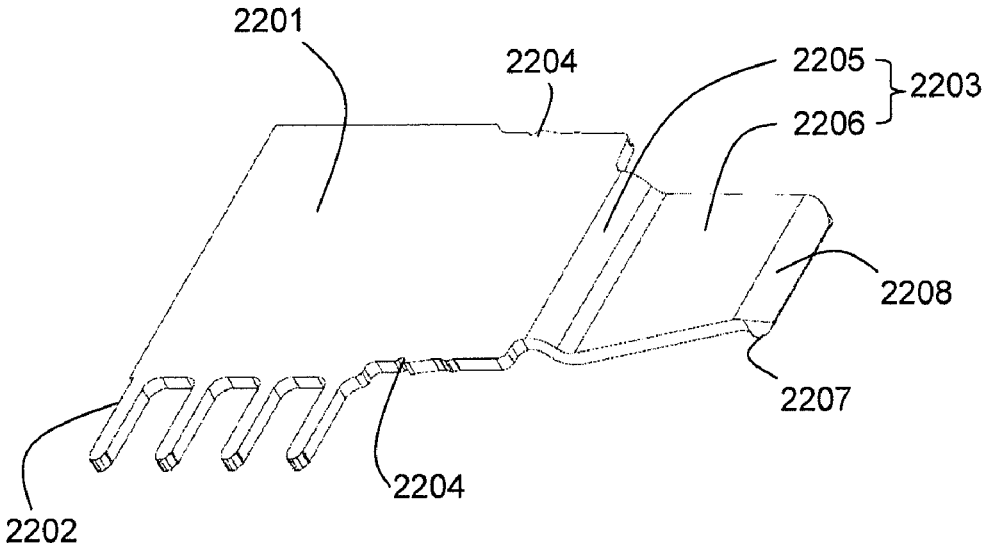
FIG. 6 is a perspective view of a receptacle terminal of the receptacle connector of FIG. 3.

The receptacle terminal group 22 comprises a plurality of receptacle terminal couples 220 arranged in the main body 210. Each receptacle terminal couple 220 consists of a pair of receptacle terminals 221, 222 spaced from each other, and arrayed in the receiving space 215 of the main body 210 in mirror image with a face-to-face style. Referring to FIG. 6, each receptacle terminal 221, 222 comprises a rectangular base plate 2201 with stab-type securing portions 2204 respectively formed on upper edge and lower edge thereof, a plurality of mounting legs 2202 extending downwardly from the base plate 2201, and a contacting arm 2203 extending forwardly from the base plate 2201. In the present embodiment, the mounting legs 2202 are all solder pins which can be soldered to the circuit board by mean of Through-Hole Technology or Press-fit Technology. However, in the another embodiment, the mounting legs 2202 can also be formed as solder pad which can be soldered to the circuit board by means of Surface-Mounting Technology. The contacting arm 2203 comprises a bending portion 2205 bending inwardly with respect to the base plate 2201, a flat contacting portion extending forwardly from the bending portion 2206, and a guiding portion 2207 formed at the end of the contacting portion 2206 and bending inwardly with respect to the contacting portion 2206. A contacting end 2208 is formed at the top of the guiding portion 2207.

Referring to FIGS. 1 and 4, the first signal terminal group 23 comprises a plurality of pin-type signal terminals 230 arranged in the passageways 219 formed in the middle portion of the main body 210, respectively.

Figure 7:
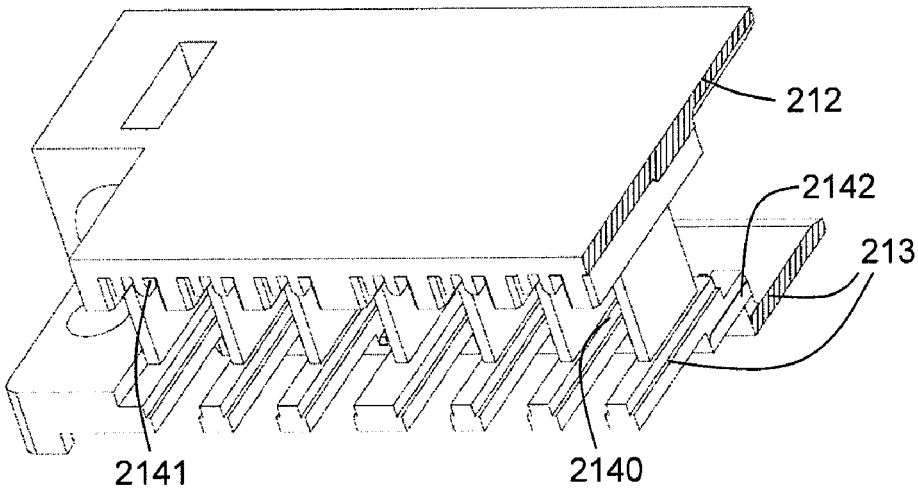
FIG. 7 is a partially cross-sectional view along line A-A of FIG. 1, only showing a cross-section of the receptacle housing.
Figure 8:
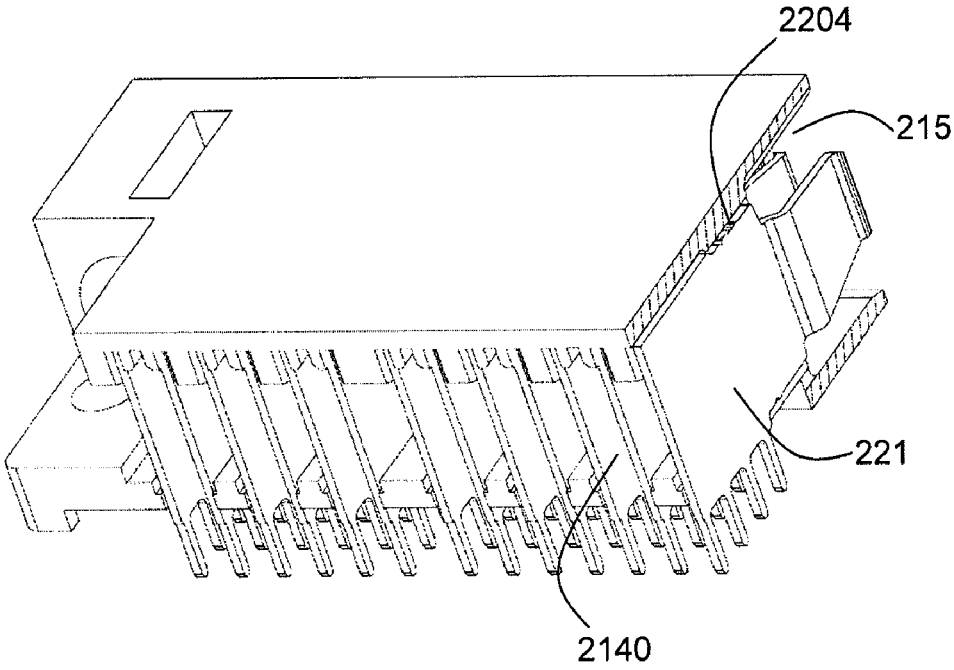
FIG. 8 is a partially cross-sectional view of the receptacle connector along line A-A of FIG. 1, showing a cross-section of assembly of the receptacle terminal in the receptacle housing.

Referring to FIGS. 5, 7 and 8, a plurality of passageways 2140 are formed in the main body 210 and divided by the middle walls 214 of the main body 210 of the receptacle housing 21 for accommodating the receptacle terminal couples 220. Each passageway 2140 comprises a pair of upper slots 2141 formed in the lower surface of the top wall 212 of the receptacle housing 21, a pair of lower slots 2142 formed in the upper surface of the bottom wall 213 of the receptacle housing 21, and a pair of convection slots 2144 formed respectively between the pair of upper slots 2141 and the pair of lower slots 2142. Each passageway 2140 receives one receptacle terminal couple 220 therein with the securing portions 2204 of the receptacle terminals 221, 222 respectively secured in the upper and the lower slots 2141, 2142. The contacting arms 2203 of the receptacle terminals 221, 222 extend forwardly into the receiving space 215 of the main body 210 and the mounting legs 2202 of the receptacle terminals 221, 222 extend downwardly out of the bottom wall 213 of the main body 210 and adapted to be mounted onto the circuit board.

Figure 9:
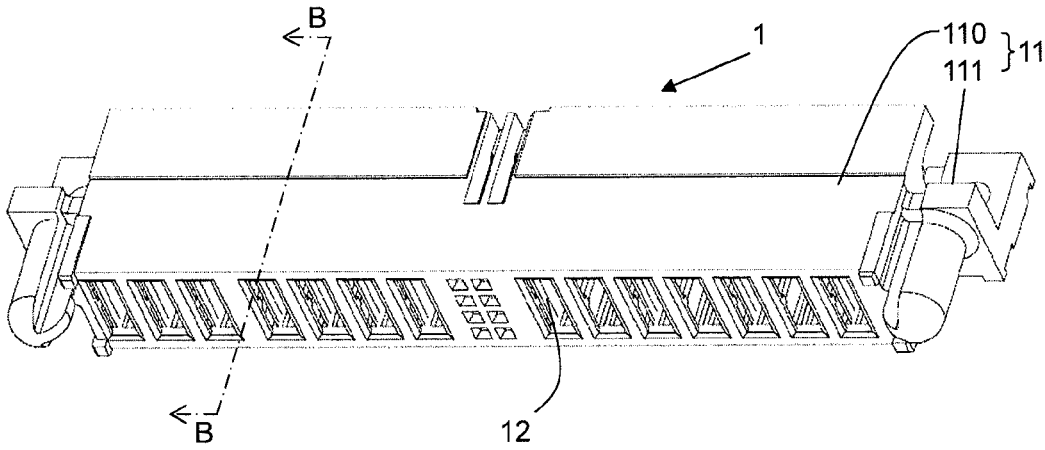
FIG. 9 is a perspective view of the plug connector of FIG. 1.
Figure 10:
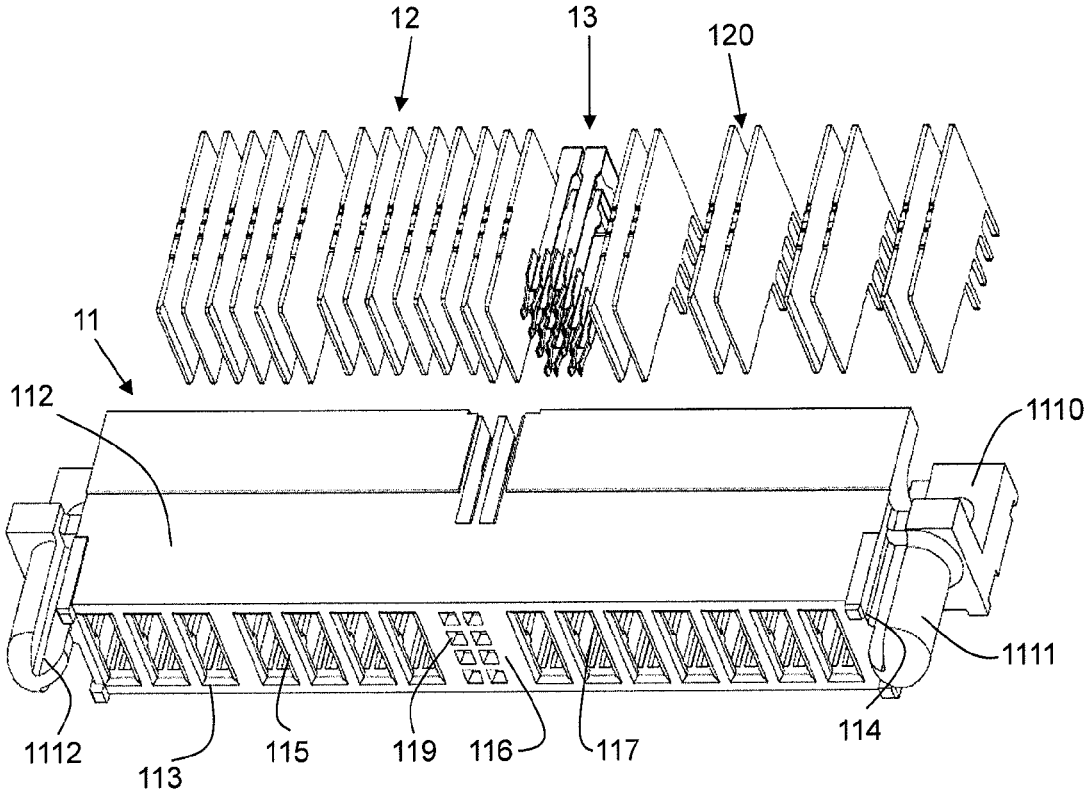
FIG. 10 is an exploded view of the plug connector of FIG. 9.
Figure 11:
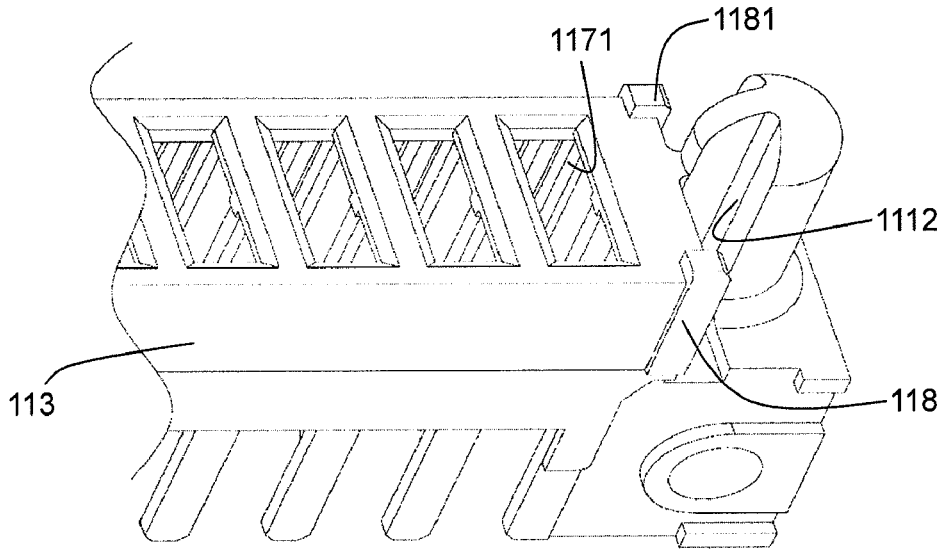
FIG. 11 is a partially enlarged view of an insulative plug housing of the plug connector of FIG. 9.

Referring to FIGS. 9 to 11, the plug connector 1 comprises an insulative plug housing 11, a plug terminal group 12 arrayed in the plug housing 11, and a second signal terminal group 13.

The insulative plug housing 11 is made of plastic material by means of injection mold process and has a rectangular shape along its longitudinal direction, which comprises a main body 110 for accommodating the plug terminals and side portions 111 respectively formed on either side of the main body 110. The main body 110 comprises a top wall 112, a bottom wall 113 parallel to the top wall 112, two side walls 114, and a plurality of division walls 115 arrayed between the top wall 112 and the bottom wall 113 and extending rearwardly from a front surface 116 of the main body 110. A passageway 117 for accommodating the plug terminals is formed between two adjacent division walls 115 and has an opening formed in the front surface 116 of the main body 110. A plurality of ribs 1150 is formed in the passageway 117 respectively on the upper portion, the middle portion and the lower portion of the side wall of the passageway 117 and extends rearwardly from the front surface 116 along the passageway 117. The side portion 111 of the plug housing 11 comprises a L-shape mounting portion 1110 adapted to be mounted onto the circuit board and a guiding post 1111 extending forwardly from the mounting portion 1110 and having two slots 1112 formed at its inner side near the side wall 114 of the main body 110. Four positioning ribs 118 are formed respectively at the four corners of the main body 110. The rib 118 formed at where the top wall 112 and the side wall 114 joints is higher than the top surface of the top wall 112 and the outer surface of the side wall 114 while the rib 118 formed at where the bottom wall 113 and the side wall 114 joints is higher than the bottom surface of the bottom wall 113 and the outer surface of the side wall 114, and the end of the rib 118 extends forwardly beyond the front surface 116 of the main body 110 and forms a positioning end 1181.

Figure 12:
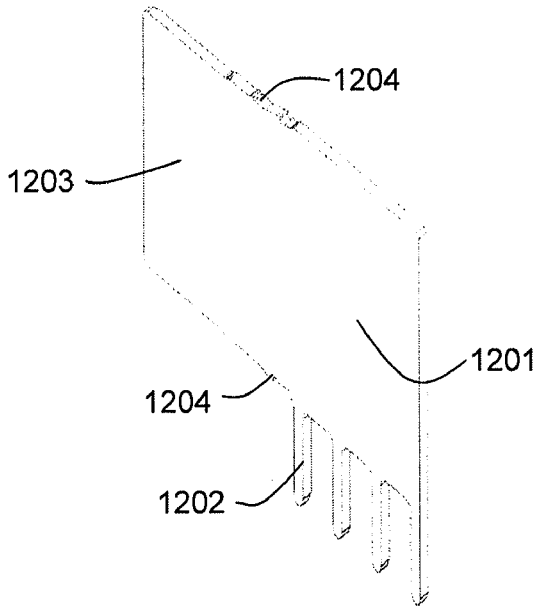
FIG. 12 is a perspective view of a plug terminal of the plug connector of FIG. 9.
Figure 13:
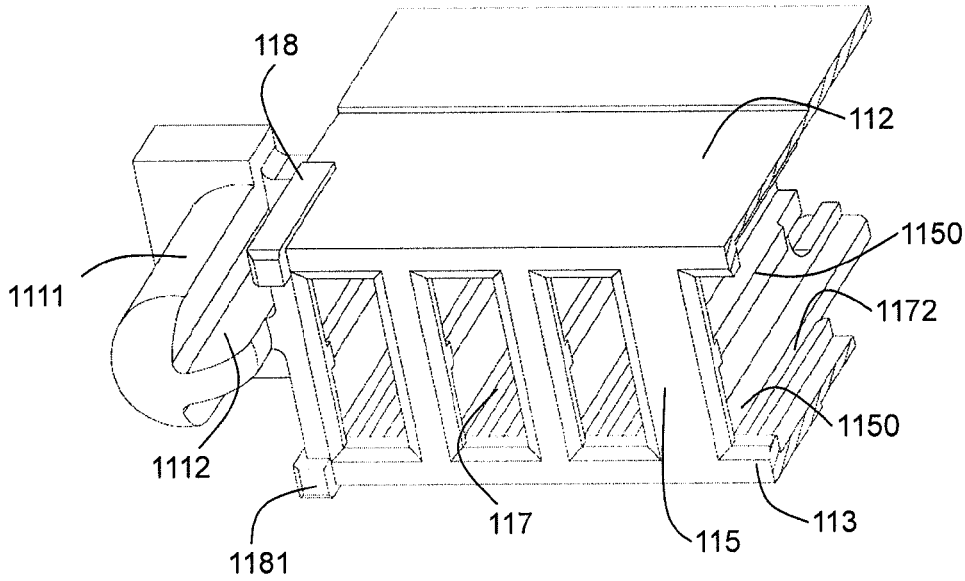
FIG. 13 is a partially cross-sectional view of the plug housing along line B-B of FIG. 9, only showing a cross-section of the plug housing.
Figure 14:
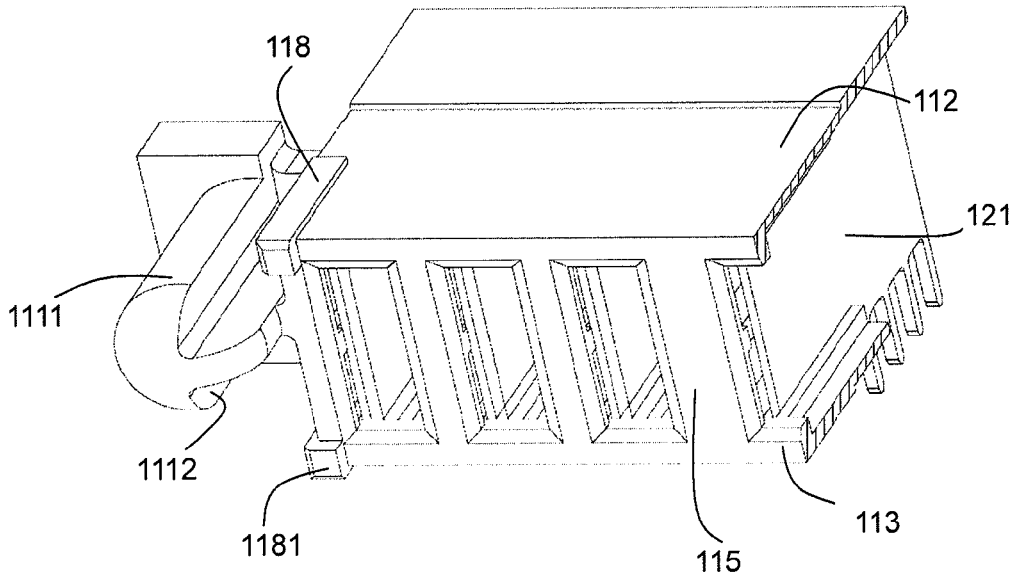
FIG. 14 is a partially cross-sectional view of the plug connector along line B-B of FIG. 9, showing a cross-section of assembly of the plug terminal in the plug housing.

The plug terminal group 12 comprises a plurality of plug terminal couples 120 arrayed in the main body 110 of he plug housing 11 for transmission of the power. Each plug terminal couple 120 comprises a pair of plug terminals 121, 122 separate from each other. Referring to FIG. 12, each plug terminal comprises a main plate 1201, a mounting leg 1202 extending downwardly from the main plate 1201, a contacting portion 1203 formed at a front part of the main plate 1201 and having a guiding end 1206 formed at the tip of the contacting portion 1203, and securing portions 1204 respectively formed at the top edge and bottom edge of the main plate 1201. The inner side of the contact portion 1203 is the contact area of the plug terminal which is adapted to be used to contact the receptacle terminal of the receptacle connector. In the present embodiment, the mounting legs 1202 comprises four solder pins which can be soldered to the circuit board by mean of Through-Hole Technology or Press-fit Technology. However, in the another embodiment, the mounting legs 1202 can also be formed as solder pad which can be soldered to the circuit board by means of Surface-Mounting Technology. In the present embodiment, the plug terminals 121, 122 of each plug terminal couple 120 are arrayed in the passageway 117 of the main body 110 in parallel and mirror image and are spaced from each other so as to formed a mating space 1205 therebetween.

Figure 15:
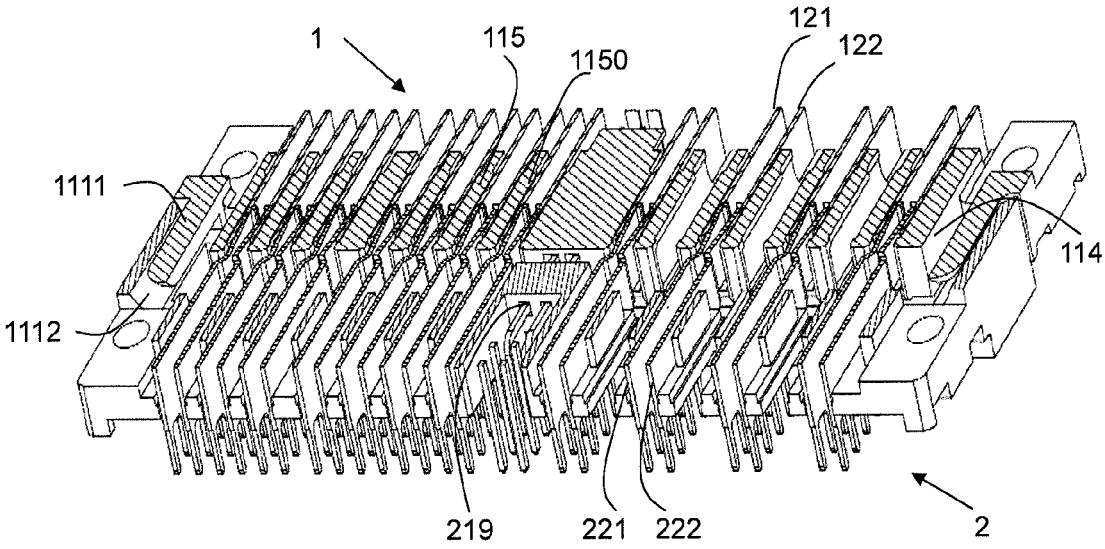
FIG. 15 is a partially cross-sectional view of the power connector assembly along line C-C of FIG. 1

Referring to FIGS. 10 and 15, The second signal terminal group 13 comprises a plurality of signal terminals 130 which are respectively accommodated in corresponding through holes 119 formed at a middle portion of the main body 110 of the plug housing 11. Each signal terminal 130 comprises a contacting portion having a pair of spring contacting arms adapted to be used to mate with the corresponding first signal terminal 230 in the receptacle connector 2.

Referring FIGS. 11 to 15, a pair of upper slots 1171 is formed in the top surface of the division wall 115 adjacent to the rib 1150 and a pair of lower slots 1172 is formed in the bottom surface of the division wall 115 adjacent to the rib 1150. The upper slot 1171 extends rearwardly in the lower surface of the top wall 112 to the rear part of the top wall 112 and the lower slot 1172 extends rearwardly in the upper surface of the bottom wall 113 to the middle part of the bottom wall 113. the main plate 1201 of each plug terminal 121, 122 is secured in the passageway 117 and resists onto the rib 1150 with the securing portions 1204 of the main plate 1201 respectively being secured into the upper slot 1171 and the lower slot 1172 of the passageway 117. The mounting leg 1202 extends downwardly through the bottom wall 113 of the plug housing 11 and is adapted to be mounted onto the circuit board. The contacting portion 1203 extends to the front part of the passageway 117 with the guiding end 1206 reaching the front surface 116 of the plug housing 11. a small space is formed between the main surface of the main plate 1201 and the inner surface of the division wall 115 which is favorable to the heat dispassion during transmission of electric power.

Figure 16:
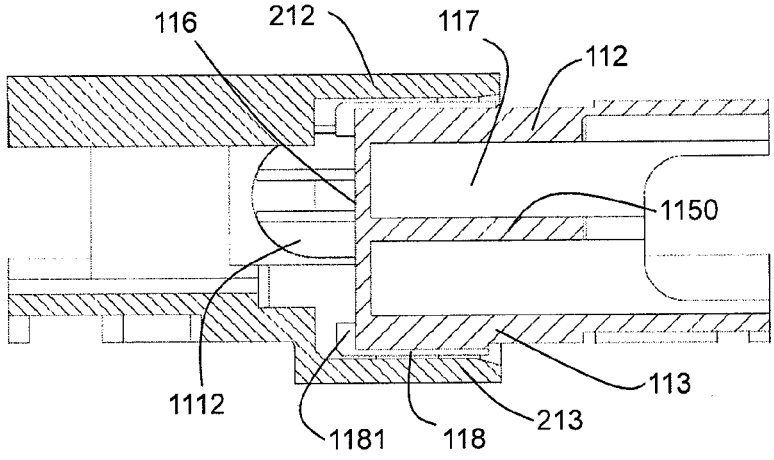
FIG. 16 is a partially cross-sectional view of the power connector assembly along line D-D of FIG. 1, only showing assembly of the receptacle housing and the plug housing.
Figure 19:
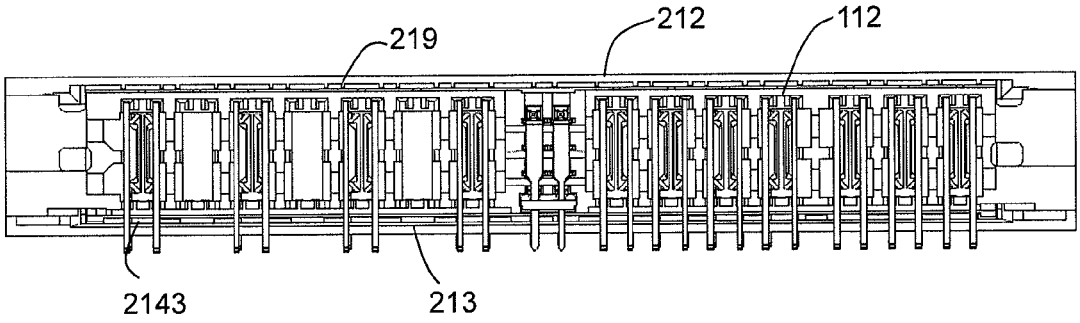
FIG. 19 is a front view of the power connector assembly of FIG. 1.

Referring to FIG. 15, FIG. 16 and FIG. 19, when the plug connector 1 mates with the receptacle connector 2, the front part of the main body 110 of the plug housing 11 inserts into the receiving space 215 of the receptacle housing 21, the receptacle terminal group 22 of the receptacle connector 2 inserts into the passageways 117 of the plug housing 11 and resists onto the plug terminal group 12 of the plug connector 1 so as to establish electrical connection therebetween, and the guiding post 1111 of the plug housing 11 mates with the guiding recess 216 of the receptacle housing 21 so as to guide and facilitate the mating process of the plug connector 1 and the receptacle connector 2.

Upon mating of the plug connector 1 and the receptacle connector 2, a plurality of airflow channels are formed between the outer surfaces of the main body 110 of the plug housing 11 and the inner surfaces of the receiving space 215 of the receptacle housing 21. The ribs 118 of the plug housing 11 resist onto the corresponding inner surfaces of the receiving space 215 of the receptacle housing 21, the height of the ribs 118 are respectively beyond the corresponding outer surfaces of the top wall 112, bottom wall 113 and the side walls 114 of the plug housing 11 so as to form small gaps between the top wall 112, bottom wall 113 and the side walls 114 of the plug housing 11 and the inner surfaces of the receiving space 215 of the receptacle housing 21. The small gaps function as the airflow channel. Meanwhile, the positioning ends 1181 of the ribs 118 also extend beyond the front surface 116 of the plug housing 11 so as to form small gap between the front surface 116 of the plug housing 11 and the corresponding surface of the receiving space 215 of the receptacle housing, which also functions as airflow channel. Furthermore, the ribs 218 in the receiving space 215 of the receptacle housing 21 also resist onto the top wall 112 of the plug housing 11, and the gaps between adjacent ribs 218 also functions as airflow channel. Moreover, the convection slots 2144 formed respectively between the pair of upper slots 2141 and the pair of lower slots 2142 in the passageway 2140 of the receptacle housing 21 also function as airflow channel. Additionally, the slots 1112 formed in the inner side of the guiding post 1111 communicate with the receiving space 215 of the receptacle housing 21 which also function as airflow channel. As a result, the airflow channels formed in different places highly facilitate dissipation of heat generated during transmission of power between the plug connector 1 and the receptacle connector 2.

Figure 17:
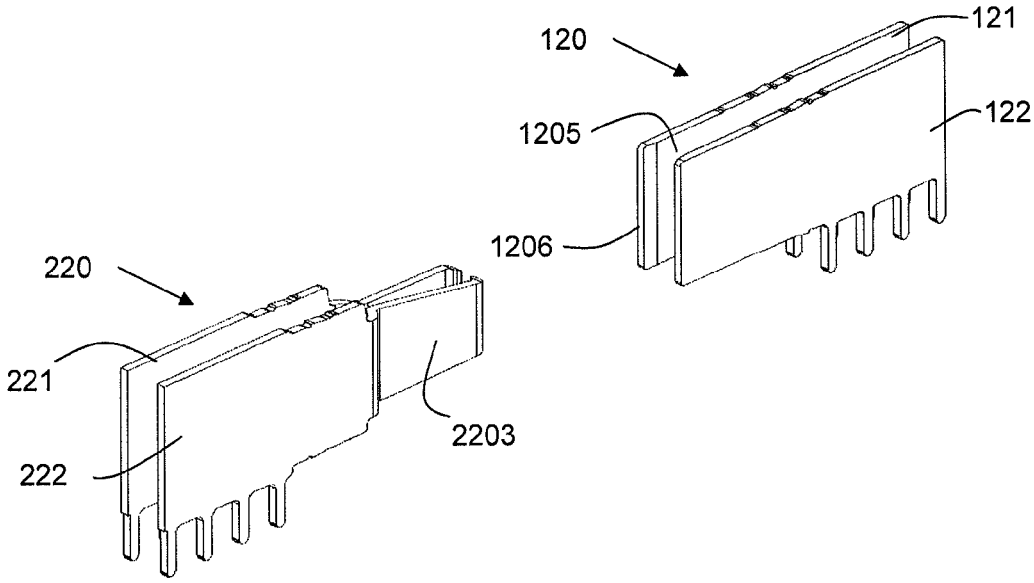
FIG. 17 is a perspective view of the plug terminal the receptacle terminal before mating.
Figure 18:
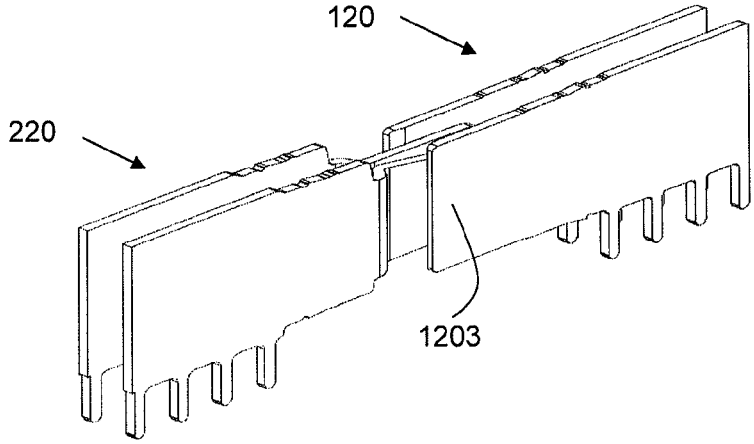
FIG. 18 is a perspective view of the plug terminal the receptacle terminal after mating.

Referring to FIGS. 17 and 18, upon mating of the plug connector 1 with the receptacle connector 2, under guiding of the guiding portions 2207 of the receptacle terminals 221, 222 and the guiding end 1206 of the plug terminals 121, 122, the contacting arms 2203 of each receptacle terminal couple 220 in the receptacle connector 2 insert into the mating space 1205 of the corresponding plug terminal couple 120 in the plug connector 1 and contact the main plates 1201 of the plug terminal couple 120 with the contacting ends 2208 of the receptacle terminals 221, 222 resisting on the contacting portion 1203 of the plug terminals 121, 122, so as to establish electrical connection between the plug connector 1 and the receptacle connector 2. The relatively big area of the base plates of the plug terminals and the receptacle terminals is favorable to the dissipation of heat, and the gap between two terminals of each terminal couple also functions as airflow channel which is favorable to dissipation of heat.

In the conventional art, the plug terminal or the receptacle terminal accommodated in one passageway of the plug connector or the receptacle connector is a one-piece structure which has an integral U-shape main plate. The bending process is inevitable during manufacture of the U-shape main plate. Comparing with the two-piece structure of the terminal couple of the present invention, the U-shape structure is much more complicated which may influence electrical characteristics of the terminal. Furthermore, the two-piece structure of the terminals of each terminal couple of the present invention can also provide two separate paths for transmission of power, which is favorable to transmission of high voltage circuit.

Although a preferred embodiment of the present invention has been described in detail for purposes of illustration, various modifications and enhancements may be made without departing from the spirit and scope of the present invention. For instance, the position of the ribs 118 of the plug housing 11 can be modified to be differing from the position as described in the preferred embodiment based on the requirement of real product. Accordingly, such modifications and enhancements shall be within the scope of the appended claims.

What is claimed is:

1. A power connector assembly, comprising:

a plug connector including an insulative plug housing and a plurality of plug terminals accommodated in the plug housing;

a receptacle connector including an insulative receptacle housing having a receiving space for receiving a part of the plug housing inserted therein and a plurality of receptacle terminals accommodated in the receptacle housing for mating with the plug terminals; and wherein airflow channels are formed between an outer surface of a main body of the plug housing in the receiving space and the inner surface of the receiving space for dissipation of heat; and wherein a plurality of ribs are formed on the outer surface of the main body, and the rib extends forwardly from a front surface of the main body and forms a position end to resist onto a corresponding surface of the receiving space of the receptacle housing.

2. The power connector assembly of claim 1, wherein the ribs are formed at the corners of a front part of the main body where the top wall and the bottom walls of the main body joint with side walls of the main body, respectively.

3. The power connector assembly of claim 1, wherein the height of the ribs are respectively beyond the outer surface of the top wall, the bottom wall and the side walls of the main body.

4. The power connector assembly of claim 1, wherein ribs are respectively formed at the upper portion, the middle portion and the lower portion of the side wall of the passageway of the plug housing, the ribs resisting onto the plug terminals in the passageway.

5. The power connector assembly of claim 1, wherein a pair of guiding post is provided on two sides of the plug housing of the plug connector, and a pair of guiding recesses is provided on two sides of the receptacle housing of the receptacle connector for mating with the guiding post.

6. The power connector assembly of claim 5, wherein slots are formed in the inner side of guiding post, the slots communicates with the guiding recess and the guiding recess communicates with the receiving space of the receptacle housing to form airflow channel.

7. The power connector assembly of claim 1, wherein a plurality of spaced ribs is provided on the inner surface of the top wall of the receiving space of the receptacle housing, the gap between adjacent ribs forming the airflow channel.

8. The power connector assembly of claim 1, wherein a plurality of passageways is formed in the receptacle housing behind the receiving space for accommodating the receptacle terminals.

9. The power connector assembly of claim 8, wherein the passageway has a pair of convection slots respectively provided at the upper wall and the lower wall of the passageway to form the airflow channel.

10. A power connector assembly, comprising:

a plug connector including an insulative plug housing having a plurality of passageways and a plurality of plug terminal couples each having a pair of separate plug terminals, each passageway accommodating a plug terminal couple, each plug terminal comprising a main plate secured in the passageway of the plug housing, and wherein ribs are provided on side walls of the passageway of the plug housing and resist onto the main plate of the plug terminal;

a receptacle connector including an insulative receptacle housing having a receiving space for receiving a part of the plug housing inserted therein and a plurality of receptacle terminal couples each having a pair of separate receptacle terminals, each passageway accommodating a receptacle terminal couple; and wherein airflow channels are formed between an outer surface of the part of the plug housing in the receiving space and the inner surface of the receiving space for dissipation of heat.

11. The power connector assembly of claim 10, wherein the passageway of the receptacle housing has a pair of upper slots and a pair of lower slots corresponding to the upper slots, and one of the receptacle terminals in the receptacle terminal couple is secured by one upper slot and one corresponding lower slot.

12. The power connector assembly of claim 11, wherein an upper convection slot is provided between the two upper slots to form the upper airflow channel of the passageway, and a lower convection slot is provided between the two lower slots to form the lower airflow channel of the passageway.

13. A power connector assembly, comprising:

a receptacle connector including a plurality of receptacle terminal couples and an insulative receptacle housing having a plurality of passageways each accommodating a receptacle terminal couple therein, each receptacle terminal couple including a pair of separate receptacle terminals spaced from each other in the passageway to form airflow channel therebetween; and a plug connector including an insulative plug housing having a plurality of passageways and a plurality of plug terminals accommodated in the passageways for mating with the receptacle terminals, each passageway having a plug terminal couple accommodated therein, the plug terminal couple including a pair of separate plug terminals spaced from each other in the passageway to form a mating space for receiving a pair of contacting arm of the receptacle terminal couple, and the plug terminal comprising a main plate, a mounting leg extending downwardly from the main plate and a contacting portion formed at a front part of the main plate.

14. The power connector assembly of claim 13, wherein the inner side of the contact portion is the contact area adapted to contacting the contacting arm of the receptacle terminal of the receptacle connector.

15. The power connector assembly of claim 13, wherein the plug connector comprises a main body having a plurality of ribs formed on the outer surface thereof and the ribs resist onto the inner surface of a receiving space of the receptacle housing when a part of the main body is inserted into the receiving space.

* * * * *